US008314670B2

(12) United States Patent
Johansson et al.

(10) Patent No.: US 8,314,670 B2
(45) Date of Patent: Nov. 20, 2012

(54) SWITCHING DEVICE

(75) Inventors: Mats Johansson, Västerås (SE); David Karlén, Västerås (SE)

(73) Assignee: ABB AB (SE)

( * ) Notice: Subject to any disclaimer, the term of this patent is extended or adjusted under 35 U.S.C. 154(b) by 0 days.

(21) Appl. No.: 13/365,653

(22) Filed: Feb. 3, 2012

(65) Prior Publication Data

US 2012/0133463 A1 May 31, 2012

Related U.S. Application Data

(63) Continuation of application No. PCT/EP2009/060081, filed on Aug. 4, 2009.

(51) Int. Cl.
*H01H 13/04* (2006.01)

(52) U.S. Cl. ..... 335/202; 335/106

(58) Field of Classification Search ..... 335/202
See application file for complete search history.

(56) References Cited

U.S. PATENT DOCUMENTS

| | | | | |
|---|---|---|---|---|
| 2,896,045 | A * | 7/1959 | Brunicardi | 335/187 |
| 4,580,005 | A * | 4/1986 | Minks et al. | 174/17.07 |
| 4,724,410 | A * | 2/1988 | Degenhart | 335/132 |
| 6,188,036 | B1 * | 2/2001 | Arnold | 218/157 |
| 6,531,941 | B1 * | 3/2003 | Greenberg et al. | 335/202 |
| 6,642,823 | B2 * | 11/2003 | Passow | 335/132 |
| 6,778,048 | B1 * | 8/2004 | Brignoni et al. | 335/132 |
| 7,358,837 | B2 * | 4/2008 | Puskar et al. | 335/6 |
| 7,474,182 | B2 * | 1/2009 | Bolz et al. | 335/131 |
| 7,482,901 | B2 * | 1/2009 | Watanabe et al. | 335/201 |
| 7,609,137 | B2 * | 10/2009 | Roesner et al. | 335/202 |
| 7,683,745 | B2 * | 3/2010 | Gouhl et al. | 335/13 |
| 7,748,105 | B2 * | 7/2010 | Kinzler et al. | 29/622 |
| 7,872,551 | B2 * | 1/2011 | Nakamura et al. | 335/4 |
| 2002/0027489 | A1 * | 3/2002 | Letient | 335/202 |
| 2006/0152312 | A1 * | 7/2006 | Stanke et al. | 335/202 |
| 2007/0042624 | A1 | 2/2007 | Gerving et al. | |
| 2010/0001820 | A1 * | 1/2010 | Fancke | 335/202 |

FOREIGN PATENT DOCUMENTS

| | | | |
|---|---|---|---|
| EP | 1220254 | A1 | 7/2002 |
| WO | 0186682 | A2 | 11/2001 |

OTHER PUBLICATIONS

International Preliminary Report on Patentability; Application No. PCT/EP2009/060081; Issued: Oct. 20, 2011; 14 pages.

International Search Report and Written Opinion of the International Searching Authority; Application No. PCT/EP2009/060081; Issued: Mar. 23, 2010; Mailing Date: Mar. 31, 2010; 9 pages.

* cited by examiner

*Primary Examiner* — Elvin G Enad
*Assistant Examiner* — Lisa Homza
(74) *Attorney, Agent, or Firm* — St. Onge Steward Johnston & Reens LLC

(57) ABSTRACT

A mechanical switching device including a base member, at least one pair of elongated conductor members mounted on the base member, each conductor member with a conductor end, wherein the conductor ends of the pair of conductor members are separated by a gap, a middle member mounted on the base member, a switch member adapted to establish and disestablish an electrical connection between the conductor ends of the pair of conductor members. Each of the conductor members includes an opening in which a respective protruding part is received. The protruding parts are provided on and extend from the middle member so that the conductor members are electrically isolated and protected from the surrounding environment around the device.

13 Claims, 2 Drawing Sheets

SWITCHING DEVICE

CROSS-REFERENCE TO RELATED APPLICATIONS

The present application is a continuation of pending International patent application PCT/EP2009/060081 filed on Aug. 4, 2009 which designates the United States, the content of which is incorporated herein by reference.

FIELD OF THE INVENTION

The present invention relates to a mechanical switching device comprising a base member, at least one pair of elongated conductor members mounted on the base member, each conductor member comprising a conductor end, wherein the conductor ends of the pair of conductor members are separated by a gap, a middle member mounted on the base member, a switch member adapted to establish and disestablish an electrical connection between the conductor ends of the pair of conductor members. Each of the conductor members comprises an opening in which a respective protruding part is received, see US2007/0042624.

BACKGROUND OF THE INVENTION

A mechanical switching device, such as a contactor, a relay, a contact breaker, etcetera, is a remotely operated electric switch used for establishing and disestablishing electric connection between the gap that separates the conductor members of the pair of conductor members from each other. In case the switching device is used for three-phase current, the switching device comprises three pairs of conductor members. The switch member comprises a moveable part that is displaced towards or away from the conductor members so that electric connection is established and disestablished between the conductor ends of the pair of conductor members.

Switching devices comprise many components, such as base member, conductor members, middle member and switch member, which are assembled together. This is done by means of an attachment arrangement comprising a large number of screw joints. Each conductor member needs to be attached to the base member in a certain position so that an appropriate gap between the conductor ends of the pair of conductor members is formed. Furthermore, the middle member needs to be attached to the base member and the switch member needs to be attached to the middle member.

In order to attach each conductor member to the base member, a switching device requires one screw joint per conductor member. Thus, a switching devices with three pairs of conductor members requires 2×3 screw joints for attaching the conductor members to the base member, at least 4 screw joints for the joining the base member and the middle member and at least 4 screw joints for attaching the switch member to the middle member.

A problem with manufacturing switching devices is that the assembly of the components is time consuming due to the large number of screw joints. Moreover, switching devices need to be disassembled for maintenance and replacement of components after certain period of operation.

US2007/0042624 presents a multi-phase switch gear device comprising pairs of conductor rails each having a bore, and two insert combs with protrusions entering the bore of each conductor rail. A problem with the disclosed switch gear device is that two insert combs are needed to attach the pair of conductor rails. The attachment of the pair of conductor rails thus requires two separate assembling steps during assemble of the device. Furthermore, the device requires a middle member that covers the conductor rails from the surrounding environment around the device. Such middle member is needed in order to assure that no foreign objects get in contact with the conductor rails, such as electrical conductive or semi-conductive elements.

SUMMARY OF THE INVENTION

The object of the present invention is an improved switching device that is easy and quick to assemble and disassemble. A further object of the invention is a switching device that requires a reduced number of screw joints for holding the components of the switching device together compared to prior art. A further object of the invention is a switching device that requires few assembling steps to be assembled or disassembled.

This object is obtained by a switching device characterized in that the protruding parts are provided on and extend from the middle member so that the base member and the middle member, in cooperation with each other, are adapted to hold and electrically isolate the conductor members of the pair of conductor members from each other, and to protect the pair of conductor members from the surrounding environment around the device.

The protruding parts of the single middle member are received by the opening of each conductor member of the pair of conductor members as the base member and the middle member are in cooperation with each other. Thereby, a position and orientation of each conductor member on the base member is fixed and each conductor member is prevented from being pulled out from the base member or pushed in further on the base member. Thus, the gap between the conductor ends of the pair of conductor members is fixed or essentially fixed. Thereby, it is not necessary to attach each conductor member to the base member by means of a screw joint or similar attachment device. Thus, the two conductor members of the pair of conductor members are attached to the base member simultaneously by means of the protruding parts of the middle member. Thereby, the structure of the device is simplified so that the assembling of the device requires a reduced number of components and a reduced number of assembling steps, which reduces the production cost of the device.

The conductor members of the pair of conductor members are protected from foreign objects that may cause a short circuit. The base member acts as a fundament for the conductor members. The middle member acts as a lid for the pair of conductor members. The base member and the middle member, in cooperation with each other, have the function of holding the conductor members in a certain position and electrically isolate the conductor members of the pair of conductor members from each other. Moreover, the base member together with the middle member creates a cover around the pair of conductor members protecting the pair of conductor members from the surrounding environment around the device.

The switch member has the function of establishing and disestablishing an electrical connection between the conductor ends of the pair of conductor members. The term "establishing an electrical connection" refers to the gap between the conductor ends of the pair of conductor members being over bridged so that the conductor ends are electrically connected with each other. The term "disestablishing an electrical connection" refers to an over bridging of the gap between the conductor ends of the pair of conductor members being removed so that the conductor ends are electrically isolated from each other.

The term "opening of the conductor member" refers to a recess or a through hole on the conductor members. The term "protruding part of the middle member" refers to a part from the middle member extending into the opening of each conductor member. The opening and the protruding part have any geometrical form that allows the protruding part to engage the opening.

According to one embodiment of the invention, the middle member comprises clamping surfaces, each clamping surface acts on the respective conductor member of the pair of conductor members in a direction towards the base member. Hence, both the clamping surface and the protruding part act on each conductor member.

The clamping surface acts on a surface of each conductor member with a force that presses the conductor member towards the base member. Thereby, the conductor member is fixed firmly between the base member and the middle member.

According to one embodiment of the invention, each protruding part of the middle member extends from the clamping surface into the opening of the respective conductor member of the pair of conductor members.

According to one embodiment of the invention, at least one of the protruding parts comprises a first flat surface and a second flat surface, the first surface and the second surface are perpendicular to a longitudinal axis of the pair of conductor members, wherein the first surface and the second surface are directed away from each other.

By means of arranging the first surface and the second surface flat or essentially flat, high shear strength is obtained without restricting the conductive area of the conductor member. Thereby, the reduction of electrical conductivity due to the opening of the conductor members is minimized. In a preferable embodiment, the at least one protruding parts comprises a rectangular form.

According to one embodiment of the invention, the base member comprises a groove that receives each of the conductor members at a certain position, in which position the respective protruding part of the middle member extends into the opening of the respective conductor member and thereby locking the conductor members of the pair of conductor members in the groove.

The groove guides each conductor member to the correct position on the base member. At the certain position of each conductor member within the groove, the respective protruding part of the middle member is allowed to extend into the opening of the conductor member so that the position of the conductor member in the groove is locked.

According to one embodiment of the invention, each conductor member is slidable in the groove along a longitudinal axis of the conductor member at least to the certain position.

According to one embodiment of the invention, the base member comprises a recess for each conductor member, wherein in the certain position of each conductor member the opening and the recess are positioned on a line and the respective protruding part of the middle member extends through the opening of the conductor member and at least into the recess of the base member.

The recess of the base member has any geometrical form that allows the respective protruding part to engage the recess. Hence, each conductor member is locked between the base member and the middle member to the certain position.

According to one embodiment of the invention, the groove comprises a bottom surface supporting each conductor member and two separated side parts, each side part comprises a side surface, wherein the bottom surface and the side surfaces are perpendicular to the longitudinal axis of the groove, wherein each conductor member is in friction contact with at least one of the side surfaces.

According to one embodiment of the invention, at least a part of the groove comprises a guide member protruding out from at least one of the side parts and thereby preventing the pair of conductor members from displacement away from the bottom surface.

Each conductor member is guided within the groove by means of the guide member during the sliding of each conductor member along the longitudinal axis of the groove to the certain position. Thereby, the each conductor member is positioned in parallel with the longitudinal axis of the groove. The guide member prevents each conductor member to slip out of the groove as each conductor member is sliding to the certain position.

According to one embodiment of the invention, the guide member comprises a guide surface directed towards the conductor members, wherein each conductor member is in friction contact with the guide surface.

According to one embodiment of the invention, the pair of conductor members extending in parallel with a plane, wherein the guide member protrudes in parallel with said plane.

According to one embodiment of the invention, at least one of the conductor members has the opening arranged on a side part of the conductor member.

Thereby, protruding parts with larger cross section than the corresponding opening may be used, wherein a first portion of the respective protruding part is extending into the opening and a second portion of the respective protruding part is extending next to the opening. In case the protruding part is made of a polymeric material, a sufficient cross section is needed in order to achieve a desired strength, such as shear strength. By means of positioning the opening on the side part of the conductor member, the negative influence on the electrical conductivity of the conductor member is reduced.

According to one embodiment of the invention, the opening is provided on a side part of the conductor members facing a side part of the groove, wherein the recess extends at least partly through one of the side parts of the groove. Thereby, protruding parts with larger cross section than the corresponding opening may be used. In case the protruding part is made of a polymeric material, a sufficient cross section is needed in order to achieve a desired strength, such as shear strength.

According to one embodiment of the invention, the switch member is mounted on the middle member, wherein the middle member supports the switch member. Such support is needed in order to hold the switch member fixed while the device is operated.

According to one embodiment of the invention, each clamping surface acts on the respective conductor member in the certain position in a direction perpendicular to the longitudinal axis of the conductor member. Thereby, each conductor member is fixed within the groove to the certain position.

According to one embodiment of the invention, the base member and the middle member is attached together by means of at least one attachment arrangement, such as a threaded bore and a bolt, creating a clamping force that clamps each of the conductor members between the respective clamping surface and the base member.

According to one embodiment of the invention, the stationary part of the switch member comprises a protruding member, wherein the base member, the conductor members, the middle member and the stationary part of the switch member are attached together by means of at least one attachment arrangement.

BRIEF DESCRIPTION OF THE DRAWINGS

The invention will now be explained more closely by the description of different embodiments, by way of example, and with reference to the appended figures.

DETAILED DESCRIPTION OF THE INVENTION

Figure 1:
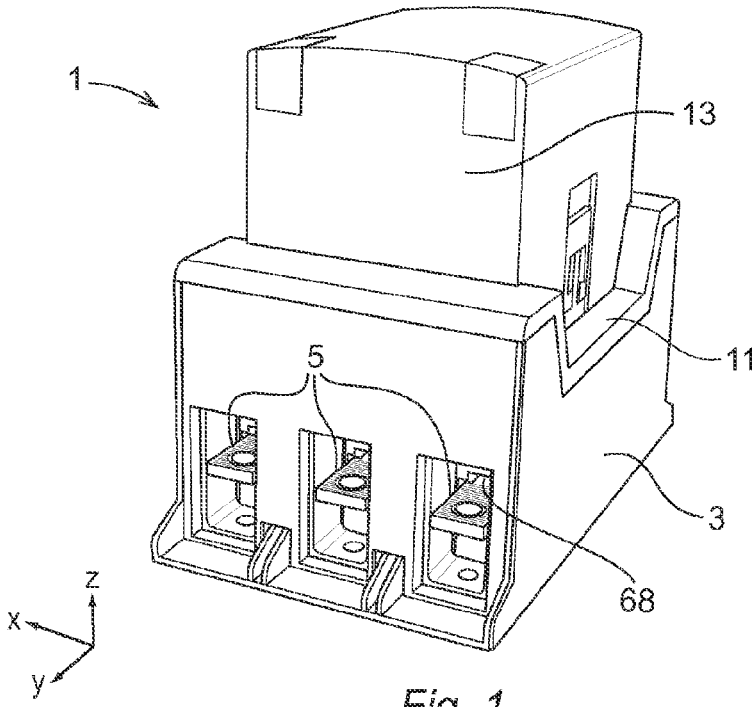
FIG. 1 shows a perspective view of a switching device.

FIG. 1 shows an example of a switching device 1 according to the invention seen from the exterior in an assembled state. The device 1 comprises a base member 3, three pairs of conductor members 5, a middle member 11 and a switch member 13. The base member 3 and the middle member 11 are preferably made of a non-conductive material such as a polymeric material, wherein the base member 3 and the middle member 11 preferably are manufactured by means of injection molding. The pair of conductor members 5 comprises an electrical conductive material, such as a copper alloy.

Two opposing sides of the base member 3 are provided with apertures 68 that receive the conductor members 5. The switch member 13 is seen with a casing that covers the interior. Each conductor member 5 is adapted to be connected to an external electric power source by means of a connection assembly such a cable clamp, cable lug, etcetera. For example, the switching device 1 is adapted to be connected to and control a three-phase current arrangement.

The device 1 further comprises an attachment arrangement adapted to hold the base member 3, the conductor members 5, the middle member 11 and the stationary part 20 of the switch member 13 together. The attachment arrangement comprises four receiving members 40, in the disclosed embodiments in the form of threaded bores, and corresponding four insert members 42, in the disclosed embodiments in the form of threaded bolts. The receiving members 40 are formed in the base member 3, the middle member 11 and a protruding member 26 of the switch member 13. The insert members 42 extend in the receiving members 40 from the protruding member 26, through the middle member 11 and into the base member 3. The attachment arrangement is not visible in FIG. 1.

Figure 2:
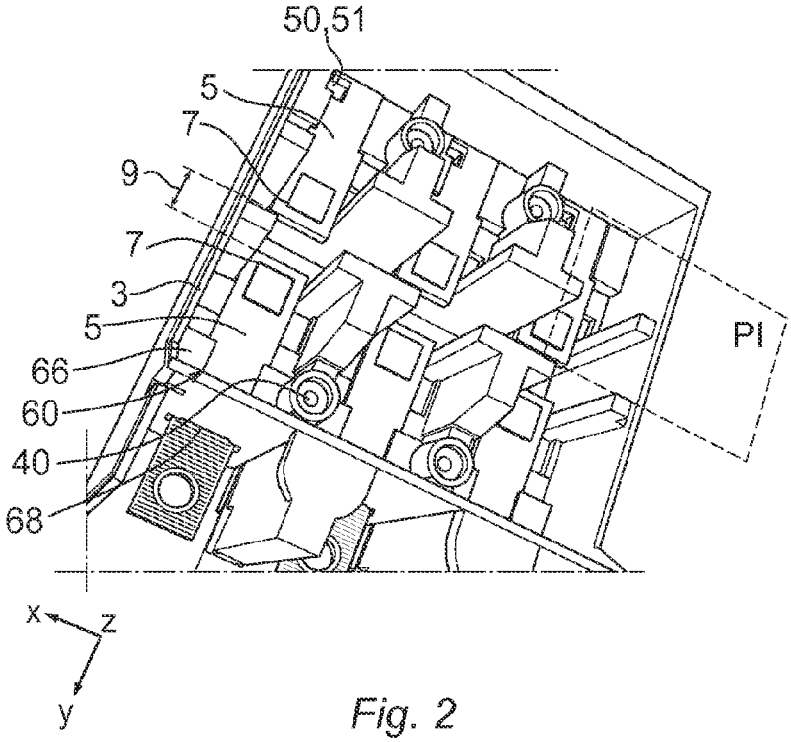
FIG. 2 shows perspective view of a base part of the switching device.

FIG. 2 shows the base part of the switching device 1. The three pairs of conductor members 5 are arranged in a plane P1 on the base member 3. The base member 3 comprises four sides forming an open compartment. Two opposing sides of the base member 3 are provided with apertures 68. The base member 3 receives each conductor member 5 through a respective one of the apertures 68 and guides the conductor member 5 by means of a groove 60 to a certain position. At the certain position an appropriate gap 9 is formed between two conductor ends 7 of each pair of conductor members 5. Each groove 60 comprises in the embodiments disclosed two guide members 66 that prevent the conductor member 5 to slip out of the groove 60. Thereby, it is assured that the conductor member 5 is positioned parallel with the extension of the groove 60 and parallel with the plane P1.

Figure 4:
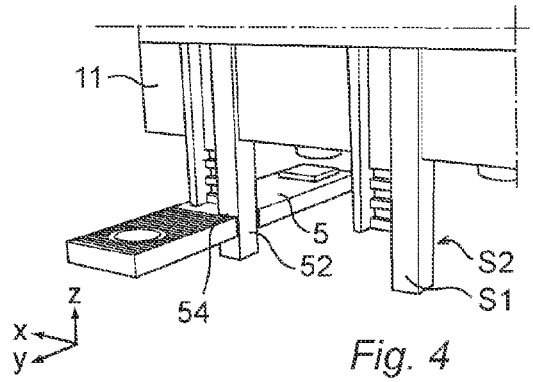
FIG. 4 shows perspective view of a middle part of the switching device.
Figure 6:
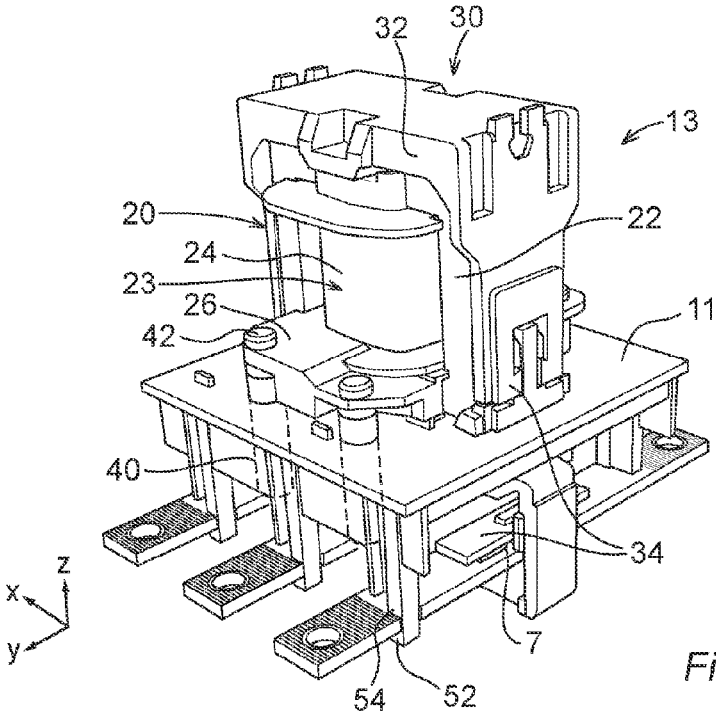
FIG. 6 shows perspective view of a switch member of the switching device.

Each conductor member 5 is provided with a through opening 50 adapted to receive a protruding part 52 of the middle member 11 at the certain position, see FIGS. 4 and 6. Furthermore, the base member 3 comprises a recess 51 adapted to receive the protruding part 52 of the middle member 11. The opening 50 in the conductor member 5 and the recess 51 in the base member 3 are positioned on a line in the certain position of each conductor member 5. Each conductor member 5 is fixed within its groove 60 between the base member 3 and the middle member 11 by means of that the protruding part 52 is received by the opening 50 of the conductor member 5 and the recess 51 of the base member 3. Thereby, the conductor member 5 is prevented from being pulled out of the groove 60 and the aperture 68. Likewise, the conductor member 5 is prevented from being pushed further inside the groove 60 of the base member 3. Thus, the gap 9 between the conductor ends 7 of the pair of conductor members 5 is set to a certain distance.

The base member 3 and the middle member 11 are adapted to be attached together by means of screw joints. The screw joints create a force that holds the base member 3 and the middle member 11 together so that a clamping surface 54 for each conductor member 5 acts on the conductor members 5 so that the conductor members 5 are clamped between the base member 3 and the middle member 11 at a fixed position within the groove 60. Thereby, each conductor member 5 will be prevented from movements within the groove 60. Such movements may occur due to play between the protruding part 52 of the middle member 11 and the opening 50 of the conductor member 5 or between protruding part 52 of the middle member 11 and the recess 51 in the base member 3.

Figure 3:
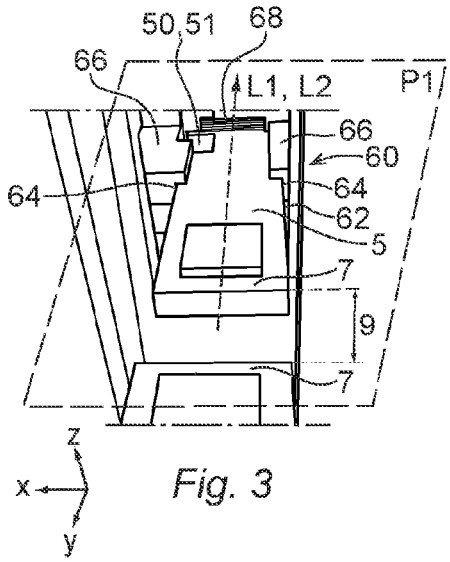
FIG. 3 shows perspective view of a groove of the switching device.

FIG. 3 shows the groove 60 on the base member 3 receiving a pair of conductor members 5. The pair of conductor member 5 is set to the certain position, wherein the conductor members 5 of the pair of conductor members 5 are separated by the desired gap 9. The groove 60 comprises a longitudinal axis L2 that is parallel with a longitudinal axis L1 of the conductor member 5. The pair of conductor members 5 is positioned parallel with a plane P1, wherein the longitudinal axis L2 of the groove 60 is parallel with the plane P1. The groove 60 comprises a bottom surface 62 that supports the conductor members 5. The groove 60 also comprises two side parts 64 with a corresponding side surface. The side surfaces are perpendicular to the bottom surface 62. The bottom surface 62 and the side surfaces are perpendicular to the longitudinal axis L2 of the groove 60. The groove 60 is arranged so that the conductor member 5 is in friction contact with the bottom surface 62 and the side surfaces.

The groove 60 comprises the guide member 66 that protrudes out from each of the side parts 64. The guide members 66 protrude essentially parallel with the plane P1 of the conductor members 5. The guide members 66 guide the conductor member 5 during insertion in the groove 60 and prevent the conductor member 5 from slipping out of the groove 60. The guide member 66 comprises a guide surface directed towards the conductor member 5. The guide surface is in friction contact with an upper side of the conductor member 5.

FIG. 4 shows the middle member 11 of the switching device 1. On a lower part of the middle member 11 is one conductor member 5 shown in order to illustrate the connection between the base member 3, the conductor members 5 and the middle member 11. The middle member 11 comprises a protruding part 52 that is received by the opening 50 on the conductor member 5 and protrudes through the conductor member 5. The protruding part 52 is extending through the conductor member 5 and is adapted to be received by the recess 51 of the base member 3. The protruding part 52 has a rectangular form that corresponds to the opening 50. The protruding part 52 has a first flat surface S1 facing the opposite direction of the longitudinal axis L1 of the conductor member 5 and a second flat surface S2 facing the direction of the longitudinal axis L1 of the conductor members 5. Preferably, the first surface S1 and the second surface S2 of the protruding part 52 are separated by a large distance. Thereby, the protruding part 52 is arranged with a large cross section that induces limited reduction of the electric conductivity of the conductor member 5. The clamping surface 54 bears against an upper side of the conductor member 5 and is adapted to press the conductor member 5 downwards into the groove 60 of the base member 3 so that the conductor member 5 is clamped between the base member 3 and the middle member 11. Thereby, each conductor members is fixed in its groove 60 by means of friction contact between the groove 60 and the conductor member 5.

An upper part of the middle member 11 comprises an upper side that acts as a cover that protects the conductor member 5 from foreign elements. The upper side of the middle member 11 supports a stationary part 20 of the switch member 13. The middle member 11 further forms four receiving members 40 that receive corresponding insert members 42 for holding the device 1 together. The middle member 11 comprises a passage for a conductor bridge for each pair of conductor members 5. The conductor bridge 34 is adapted to establish and disestablish an electrical connection between the conductor ends 7 of the pair of conductor members 5.

Figure 5:
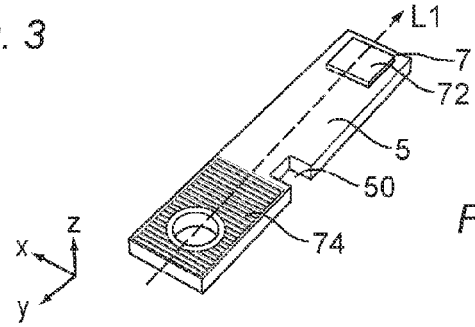
FIG. 5 shows perspective view of a conductor member of the switching device.

FIG. 5 shows an example of the conductor member 5. The conductor member 5 has a flat elongated form with a longitudinal axis L1. The opening 50 is provided on a side part of the conductor member 5. The opening 50 is in the form of a slit in the conductor member 5. Thereby, the respective protruding part 52 has the ability to extend both into the opening 50 and next to the opening 50. Thereby, the protruding part 52 may be arranged with a larger cross section than the corresponding opening 50. The conductor member 5 comprises a conductor end 7 that is adapted to face the opposing conductor end 7 of the pair of conductor members 5. The conductor end 7 is provided with sheet metal shield 72 that is adapted to get in contact with a corresponding sheet metal shield of the conductor bridge 34. The conductor member 5 further comprises a connection end 74 on the opposite side of the conductor end 7. The connection end 74 is adapted to be connected to external power. The connection end 74 is provided with a through hole that is adapted to receive the connection assembly such a cable clamp, cable lug, etcetera.

FIG. 6 shows the switch member 13 mounted on the middle member 11. The switch member 13 comprises a stationary part 20 and a movable part 30. The movable part 30 comprises a conductor bridge 34 that is adapted to be displaced in a direction towards or away from the conductor members 5 between a first position and a second position, wherein in the first position the two conductor ends 7 lack electrical connection and in the second position the two conductor ends 7 are electrical connected by means of the conductor bridge 34 bridging over the gap 9 between the two conductor ends 7 of each pair of conductor members 5.

The stationary part 20 of the switch member 13 further comprises a stationary magnetic part 22 and an electric coil 23. The stationary magnetic part 22 has a U-shaped form and is made of a ferromagnetic material such as iron. The coil 23 comprises a bobbin 24 with a conductive wire coiled around the bobbin 24. The conductive wire is supplied with a current so that the coil 23 creates a magnetic field. The coil 23 is positioned inside the open space of the U-shaped stationary magnetic part 22.

The movable part 30 comprises a movable magnetic part 32 and the conductor bridge 34. The movable magnetic part 32 has a T-shaped form and is made of a ferromagnetic material such as iron. The movable magnetic part 32 is adapted to be displaced inside the coil 23 by means of that the magnetic field created by the coil 23 pulls the movable magnetic part 32 towards the stationary magnetic part 22 so that the T-formed part enters into the U-formed part. The conductor bridge 34 is connected to the movable magnetic part 32 and is moved towards and away from the conductor members 5 so that an electrical connection is established respectively disestablished.

The bobbin 24 has a protruding member 26 that protrudes parallel with the upper side of the middle member 11. The base member 3, the middle member 11 and the protruding member 26 is attached together by means of the attachment arrangement. Thereby, the base member 3 and the middle member 11 form a compartment that protects the conductor members 5 from foreign elements that may cause a short circuit.

The present invention is not limited to the embodiments disclosed but may be varied and modified within the scope of the following claims.

What is claimed is:

1. A mechanical switching device comprising:

a base member, at least one pair of elongated conductor members mounted on the base member, each conductor member comprising a conductor end, wherein the conductor ends of the pair of conductor members are separated by a gap, a middle member mounted on the base member so that conductor members of the pair of conductor members are covered by the base member and the middle member, wherein the pair of conductor members are protected from foreign objects that may cause a short circuit, a switch member adapted to establish and disestablish an electrical connection between the conductor ends of the pair of conductor members, wherein each of the conductor members comprises an opening in which a respective protruding part is received, and wherein the protruding parts extend from the middle member so that the base member and the middle member, in cooperation with each other, are adapted to hold and electrically isolate the conductor members of the pair of conductor members from each other.

2. The mechanical switching device according to claim 1, wherein the middle member comprises clamping surfaces, each clamping surface acts on the respective conductor member of the pair of conductor members in a direction towards the base member.

3. The mechanical switching device according to claim 2, wherein each protruding part of the middle member extends from the clamping surface into the opening of the respective conductor member of the pair of conductor members.

4. The mechanical switching device according to claim 1, wherein at least one of the protruding parts comprises a first flat surface and a second flat surface, the first surface and the second surface are perpendicular to a longitudinal axis of the pair of conductor members, wherein the first surface and the second surface are directed away from each other.

5. The mechanical switching device according to claim 4, wherein the base member comprises a groove, the groove having a bottom surface supporting each conductor member and two separated side parts, each side part comprising a side surface, wherein the bottom surface and the side surfaces are perpendicular to a longitudinal axis of the groove, wherein each conductor member is in friction contact with each of the side surfaces.

6. The mechanical switching device according to claim 5, wherein at least a part of the groove comprises a guide member protruding out from at least one of the side parts and thereby preventing the pair of conductor members from displacement away from the bottom surface.

7. The mechanical switching device according to claim 6, wherein the guide member comprises a guide surface directed towards the conductor members, wherein each conductor member is in friction contact with the guide surface.

8. The mechanical switching device according to claim 6, wherein the pair of conductor members extends in parallel with a plane, wherein the guide member protrudes in parallel with said plane.

9. The mechanical switching device according to claim 1, wherein the base member comprises a groove that receives each of the conductor members at a certain position, in which position the respective protruding part of the middle member extends into the opening of the respective conductor member and thereby locking the conductor members of the pair of conductor members in the groove.

10. The mechanical switching device according to claim 9, wherein each conductor member is slidable in the groove along a longitudinal axis of the conductor member at least to the certain position.

11. The mechanical switching device according to claim 9, wherein the base member comprises a recess for each conductor member, wherein in the certain position of each conductor member the opening and the recess are positioned on a line and the respective protruding part of the middle member extends through the opening of the conductor member and at least into the recess of the base member.

12. The mechanical switching device according to claim 1, wherein at least one of the conductor members has the opening arranged on a side part of the conductor member.

13. The mechanical switching device according to claim 1, wherein the switch member is mounted on the middle member, wherein the middle member supports switch member.

* * * * *